US009746238B2

(12) United States Patent
Lim et al.

(10) Patent No.: US 9,746,238 B2
(45) Date of Patent: Aug. 29, 2017

(54) DRUM WASHING MACHINE

(71) Applicant: SAMSUNG ELECTRONICS CO., LTD., Suwon-si, Gyeonggi-do (KR)

(72) Inventors: Hyung Sub Lim, Suwon-si (KR); Min Hee Kang, Busan (KR); Seok Geun Bae, Hwaseong-si (KR); Sang Oh Yoo, Suwon-si (KR); Geun Kang, Hwaseong-si (KR); Hye Joon Seok, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 428 days.

(21) Appl. No.: 14/183,719

(22) Filed: Feb. 19, 2014

(65) Prior Publication Data

US 2014/0230270 A1 Aug. 21, 2014

(30) Foreign Application Priority Data

Feb. 20, 2013 (KR) ..... 10-2013-0018324

(51) Int. Cl.
*F26B 11/02* (2006.01)
*F26B 21/06* (2006.01)
(Continued)

(52) U.S. Cl.
CPC ..... *F26B 21/06* (2013.01); *D06F 25/00* (2013.01); *D06F 58/02* (2013.01); *D06F 58/20* (2013.01);
(Continued)

(58) Field of Classification Search
CPC ..... D06F 58/24; D06F 25/00; D06F 39/083; D06F 2204/084; D06F 49/08;
(Continued)

(56) References Cited

U.S. PATENT DOCUMENTS 3,797,142 A * 3/1974 Gerod ..... D06F 71/34 38/15
2003/0066206 A1* 4/2003 Woo ..... D06F 25/00 34/425
(Continued)

FOREIGN PATENT DOCUMENTS

DE 102009002482 A1 10/2010
EP 2019162 A1 1/2009
(Continued)

OTHER PUBLICATIONS

Extended European Search Report dated Jun. 26, 2014 in corresponding European Patent Application No. 14155893.2.
(Continued)

*Primary Examiner* — Jason Lau
(74) *Attorney, Agent, or Firm* — Staas & Halsey LLP

(57) ABSTRACT

A drum washing machine having an improved air circulation structure thereof. The drum washing machine includes a cabinet, a tub arranged within the cabinet, a drum rotatably arranged within the tub, a drying unit which heats and circulates air discharged from the tub so as to dry laundry within the drum, the drying unit including a drying duct equipped with a heater to heat air therein, a circulation passage provided such that air circulates between the tub and the inside of the drying duct, and a suction member which is coupled to one side of the drying duct and introduces air outside the tub onto the circulation passage, and a discharge member which is coupled to one side of the tub and discharges part of the air in the circulation passage to the outside of the cabinet.

14 Claims, 17 Drawing Sheets

(51) Int. Cl.

| | |
|---|---|
| ***D06F 58/02*** | (2006.01) |
| ***D06F 58/28*** | (2006.01) |
| ***D06F 25/00*** | (2006.01) |
| ***D06F 58/20*** | (2006.01) |

(52) U.S. Cl.
CPC ..... *D06F 58/28* (2013.01); *D06F 2058/2864* (2013.01)

(58) Field of Classification Search
CPC ..... A47L 15/4223; F16K 24/044; B01D 2311/04; B01D 21/2444; B01D 21/0012; B01D 2311/2619; B01D 2311/06; B01D 24/008; B01D 33/11; B01D 21/0006; B01D 2311/18; B01D 2311/2623; B01D 2311/2626; B01D 24/14; B01D 24/04
See application file for complete search history.

(56) References Cited

U.S. PATENT DOCUMENTS

| | | | | |
|---|---|---|---|---|
| 2003/0200773 | A1* | 10/2003 | Hong | D06F 25/00 68/20 |
| 2004/0168344 | A1 | 9/2004 | Park | |
| 2012/0030960 | A1 | 2/2012 | Ryoo et al. | |
| 2012/0260520 | A1 | 10/2012 | Hong et al. | |

FOREIGN PATENT DOCUMENTS

| | | | |
|---|---|---|---|
| EP | 2116647 | A1 | 11/2009 |
| GB | 2387895 | A | 10/2003 |
| KR | 2001-0009544 | | 2/2001 |
| KR | 2003-0028949 | | 4/2003 |
| KR | 2003-0084065 | | 11/2003 |
| KR | 10-2005-0101807 | | 10/2005 |
| KR | 10-2006-0004363 | | 1/2006 |
| WO | 2012/053751 | A1 | 4/2012 |

OTHER PUBLICATIONS

PCT International Search Report mailed Apr. 28, 2014 in corresponding International Patent Application No. PCT/KR2014/001169.
Korean Office Action dated May 27, 2016 from Korean Patent Application No. 10-2013-0018324, 24 pages.
Russian Office Action dated May 11, 2016 from Russian Patent Application No. 2015134539/12(053047), 5 pages.
Chinese Office Action dated Jan. 24, 2017 from Chinese Patent Application No. 201410058932.1, 16 pages.
Korean Office Action dated Nov. 11, 2016 from Korean Patent Application No. 10-2013-0018324, 9 pages.
Russian Office Action dated Oct. 4, 2016 from Russian Patent Application No. 2015134539/12(053047), 11 pages.
Philippines Office Action dated May 22, 2017 in related Philippines Application 1/2015/501212.

* cited by examiner

DRUM WASHING MACHINE

CROSS-REFERENCE TO RELATED APPLICATIONS

This application claims the benefit of Korean Patent Application No. 10-2013-0018324, filed on Feb. 20, 2013 in the Korean Intellectual Property Office, the disclosure of which is incorporated herein by reference.

BACKGROUND

1. Field

Embodiments of the present disclosure relate to a drum washing machine having an improved air circulation structure thereof.

2. Description of the Related Art

In general, a drum washing machine having a drying function includes a drying device which blows hot air by a drying heater into a space receiving laundry to dry laundry. The drum washing machine performs a drying function alone or performs a drying function in tandem with a washing function after completion of dehydration, using the drying device.

A typical drying device of a washing machine evaporates moisture in laundry by supplying hot air heated by a heating device into a drum to heat the laundry and dries the laundry by condensing and discharging the evaporated moisture.

Such a drying device includes a drying duct to supply hot air into the drum, and the drying duct is equipped with the heating device and is connected, at one end thereof to an outlet of a blowing fan while being connected, at the other end thereof, to the drum so as to communicate with the inner portion of the drum. In addition, the drying device includes a condensation duct to condense and discharge moisture in the process of guiding humid air within the drum to the blowing fan, and the condensation duct is connected, at one end thereof, to the drum so as to communicate with the inner portion of the drum while being connected, at the other end thereof, to an inlet of the blowing fan.

In the related art, humid air discharged from a tub is condensed using water in the condensation duct. However, there is a limit to a degree of condensation and thus drying efficiency is decreased.

In addition, since water for condensation (hereinafter, referred to as "condensation water") is continuously supplied in order to absorb moisture in laundry and condense hot and humid air, an amount of water used is increased.

Furthermore, since the condensation duct is located between the tub and a cabinet, there is a limit to increasing a receiving capacity of laundry within a given space.

SUMMARY

Therefore, it is an aspect of the present disclosure to provide a drum washing machine capable of enhancing condensation efficiency by improving an air circulation structure thereof.

Additional aspects of the disclosure will be set forth in part in the description which follows and, in part, will be apparent from the description, or may be learned by practice of the disclosure.

In accordance with one aspect of the present disclosure, a drum washing machine includes a cabinet, a tub arranged within the cabinet, a drum rotatably arranged within the tub, a drying unit which heats and circulates air discharged from the tub so as to dry laundry within the drum, the drying unit including a drying duct equipped with a heater to heat air therein, a circulation passage provided such that air circulates between the tub and the inside of the drying duct, and a suction member which is coupled to one side of the drying duct and introduces air outside the tub onto the circulation passage, and a discharge member which is coupled to one side of the tub and discharges part of the air in the circulation passage to the outside of the cabinet.

The suction member may be provided with at least one inlet such that a passage into which air is sucked from an upper side of the inlet is formed in order to suck air outside the tub.

The suction member may include a front member to which a blowing fan to heat and circulate air in the tub is seated and a rear member provided with the inlet.

The rear member may include a rear communication port through which air sucked into the inlet moves, and the front member may include a front communication port through which air sucked into the rear member moves.

The discharge member may include a first introduction port, at one side thereof, through which air in the tub is introduced, a second introduction port, at the other side thereof, through which wash water is introduced, and a discharge port through which at least one of air and wash water is discharged.

The discharge port of the discharge member may be coupled to a coupling hole of the cabinet so as to protrude outward of the cabinet.

The coupling hole of the cabinet coupled with the discharge port of the discharge member may be located at a point which is two-thirds from the bottom of the cabinet.

The discharge member may include a first discharge member provided with the first introduction port and a second discharge member provided with the second introduction port, and the first and second discharge members may be coupled to each other.

The discharge member may further include an opening and closing member to open and close a passage of air discharged to the discharge member.

The opening and closing member may be provided in a membrane shape so as to be capable of opening and closing the passage of air by pressure of air.

The opening and closing member may be provided as a buoyancy valve capable of opening and closing the passage of air using buoyancy generated by wash water.

At least a portion of the front member may be provided with a slit for suction of external air.

In accordance with another aspect of the present disclosure, a drum washing machine to perform a drying function includes a cabinet, a tub arranged within the cabinet, a drum rotatably arranged within the tub, a drying duct coupled to one side of the tub, the drying duct being equipped with a heater to heat air therein such that, during performance of the drying function, air absorbing moisture in laundry within the drum circulates between the tub and the drying duct so as to remove the moisture, and an introduction passage located between the tub and the drying duct such that air outside the tub having relatively low humidity compared with air inside the tub is introduced into the introduction passage and condensation efficiency of hot and humid air inside the tub is capable of being enhanced.

The introduction passage may be provided in a suction member coupled to one side of the tub, the suction member may include a front member to which a blowing fan is seated and a rear member provided with an inlet through which air is sucked, and at least a portion of the front member may be provided with a slit for suction of air.

The drum washing machine may further include a discharge passage provided outside the tub such that air is capable of being discharged to the outside of the tub.

The drum washing machine may further include a discharge member that includes a first introduction port, at one side thereof, through which air in the tub is introduced, a second introduction port, at the other side thereof, through which wash water is introduced, and a discharge port through which at least one of humid air and wash water is discharged, and the discharge passage may be provided in the discharge member coupled to one side of the tub.

The discharge member may include an opening and closing member to open and close a passage of air introduced into the discharge member.

In accordance with another aspect of the present disclosure, a drum washing machine to perform a drying function includes a cabinet, a tub arranged within the cabinet, a drum rotatably arranged within the tub, a drying duct to heat and circulate air in the tub, and a discharge member coupled to one side of the tub to discharge at least one of wash water and air to the outside of the cabinet, wherein a circulation passage which forms a circulation flow of air such that air move between the tub and the drying duct is formed, a discharge passage configured such that air in the tub is discharged to the outside of the cabinet is formed, and the discharge passage is provided in the discharge member.

The discharge member may include a first introduction port which communicates with an upper side of the tub such that humid air in the tub is introduced through the first introduction port, a second introduction port through which wash water discharged from the tub is introduced, and a discharge port which communicates with the first and second introduction ports such that at least one of air and wash water is discharged through the discharge port.

The second introduction port may be coupled to a first hose through which wash water is discharged from the tub.

The discharge port may be coupled to a second hose through which air introduced through the first introduction port and wash water introduced through the second introduction port are discharged.

The discharge member may include a first discharge member provided with the first introduction port and a second discharge member provided with the second introduction port and the discharge port, and the first and second discharge members may be coupled to each other.

The drum washing machine may further include an opening and closing member which is coupled to a boundary surface between the first and second discharge members and opens and closes a passage of air introduced from the first introduction port.

The discharge port of the discharge member may be coupled to a coupling hole of the cabinet so as to protrude outward of the cabinet, and the coupling hole may be located at a point which is two-thirds from the bottom of the cabinet.

The drum washing machine may further include a suction member provided therein with a passage through which air between the cabinet and the tub is sucked, the suction member being coupled to a lower side of the drying duct.

In accordance with a further aspect of the present disclosure, a drum washing machine includes a cabinet, a tub arranged within the cabinet, a drum rotatably arranged within the tub, a drying duct to heat and circulate condensed air within the tub, a suction member which is coupled, at one side thereof, to a lower side of the drying duct and is coupled, at other side thereof, to one side of the tub so as to communicate with the tub, a blowing fan being seated to the suction member, the suction member being configured such that air inside and outside the tub is sucked into the suction member, and a discharge member coupled to the other side of the tub, the discharge member including an introduction port through which air in the tub is introduced and a discharge port through which the introduced air is discharged.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
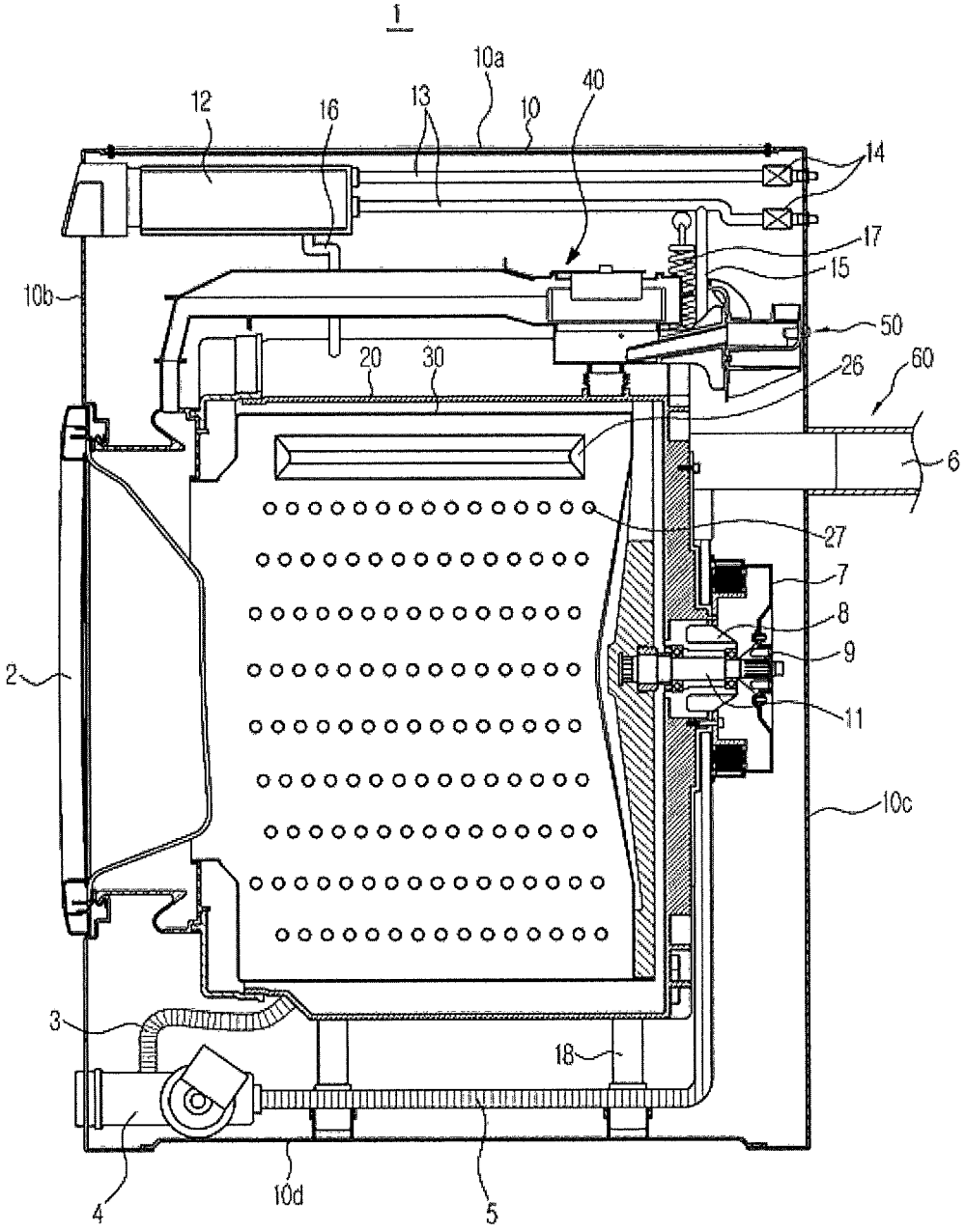
FIG. 1 is a cross-sectional view of a drum washing machine according to an embodiment of the present disclosure.

Reference will now be made in detail to the embodiments of the present disclosure, examples of which are illustrated in the accompanying drawings, wherein like reference numerals refer to like elements throughout.

Figure 2:
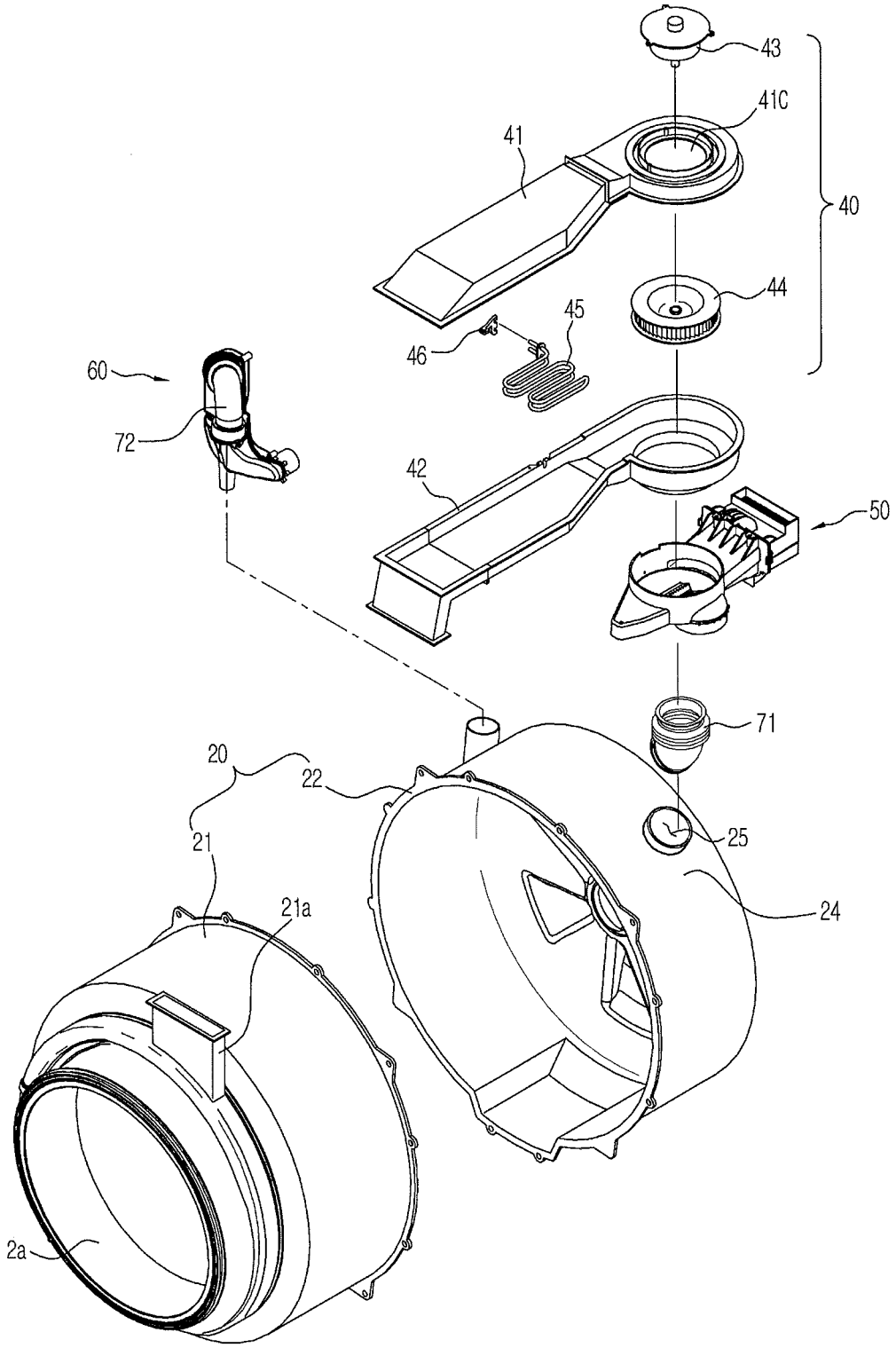
FIG. 2 is an exploded perspective view illustrating the drum washing machine according to the embodiment of the present disclosure.

FIG. 1 is a cross-sectional view of a drum washing machine according to an embodiment of the present disclosure. FIG. 2 is an exploded perspective view illustrating the drum washing machine according to the embodiment of the present disclosure.

As shown in FIGS. 1 and 2, the drum washing machine 1 includes a cabinet 10, a tub 20 arranged within the cabinet 10, a drum 30 rotatably arranged within the tub 20, and a motor 7 to drive the drum 30.

The tub 20 may include a first tub 21 located at the front inside the cabinet 10 and a second tub 22 coupled to a rear portion of the first tub 21. The first tub 21 includes a cylindrical portion arranged in a circumferential direction thereof and a front plate located at the front of the cylindrical portion. The second tub 22 includes a cylindrical portion 24 arranged in a circumferential direction thereof and a rear plate located at the rear of the cylindrical portion 24. The tub 20 is constituted by coupling the cylindrical portion of the first tub 21 to the cylindrical portion 24 of the second tub 22.

The cabinet 10 includes frames 10*a*, 10*b*, 10*c*, 10*d*, and 10*e*. The frames 10*a*, 10*b*, 10*c*, 10*d*, and 10*e* are respectively constituted of an upper frame 10*a* forming an upper surface of the cabinet 10, a front frame 10*b* and a rear frame 10*c* which form a front surface and a rear surface of the cabinet 10, and a side frame 10*e* and a lower frame 10*d* which connect the front frame 10*b* and the rear frame 10*c* and form a side surface and a lower surface of the cabinet 10.

The front frame 10*b* of the cabinet 10 is formed with an insertion port 2*a* through which laundry may be inserted into the drum 30. The insertion port 2*a* is opened and closed by a door 2 mounted to the front frame 10*b* of the cabinet 10.

A spring 17 to support the tub 20 at an upper side thereof may be provided between the tub 20 and the cabinet 10. The spring 17 serves to attenuate vibration and noise caused by motion of the tub 20 due to elastic force of the spring 17.

The tub 20 is provided, at an upper portion thereof, with second water supply tubes 13 to supply wash water to the tub 20. A first water supply tube 15 is connected to one side of a drying duct 40. Each of the second water supply tubes 13 is connected, at one side thereof, with an external water source (not shown) through water supply valves 14 while being connected, at the other side thereof, with a detergent supply unit 12.

The detergent supply unit 12 is connected to the tub 20 through a connection tube 16. Water supplied through the second water supply tube 13 is supplied into the tub 20 together with detergent via the detergent supply unit 12. In accordance with the embodiment of the present disclosure, the detergent supply unit 12 may be connected to the first tub 21 through the connection tube 16. This is because the detergent supply unit 12 is located at the front inside the cabinet 10.

The tub 20 is supported by a damper 18. The damper 18 connects an inside bottom surface of the cabinet 10 to an outer surface of the tub 20. In addition, the damper 18 may also be located at the upper side and the left and right sides of the cabinet 10 in addition to the inside bottom surface of the cabinet 10 so as to support the tub 20. The damper 18 or the spring 17 may attenuate vibration and impact caused by vertical motion of the tub 20 above and below the tub 20.

The rear of the drum 30 is connected with a drive shaft 11 to which the motor 7 transmits power. A plurality of through holes 27 through which wash water passes are formed around the drum 30. A plurality of lifters 26 are installed on an inner peripheral surface of the drum 30 so that laundry is tumbled during rotation of the drum 30.

The drive shaft 11 is disposed between the drum 30 and the motor 7. One end of the drive shaft 11 is connected to the rear plate of the drum 30, and the other end of the drive shaft 11 extends outside a rear wall of the tub 20. When the motor 7 drives the drive shaft 11, the drum 30 connected to the drive shaft 11 rotates about the drive shaft 11.

The rear plate of the second tub 22 is provided with a bearing housing 8 so as to rotatably support the drive shaft 11. The bearing housing 8 may be made of an aluminum alloy, and be inserted into the rear wall of the second tub 22 during injection molding of the second tub 22. Bearings 9 are installed between the bearing housing 8 and the drive shaft 11 so that the drive shaft 11 may be smoothly rotated.

The tub 20 is provided, at a lower portion thereof, with a drainage pump 4 to discharge water within the tub 20 to the outside of the cabinet 10, a connection hose 3 connecting the tub 20 to the drainage pump 4 such that water within the tub 20 may be introduced into the drainage pump 4, and a first hose 5 as a drainage hose to guide water pumped by the drainage pump 4 to the outside of the cabinet 10. A detailed description will be given thereof below.

The tub 20 is provided with a drying unit which dries hot and humid air within the tub 20 and then supplies the dried air into the tub 20 again. In accordance with the embodiment of the present disclosure, the drying unit is constituted of the tub 20 in which moisture in air is condensed and a drying duct 40 in which the condensed air is heated and supplied into the drum 30. The drying unit heats and circulates air within the tub 20 so as to dry laundry within the drum 30. Thus, a circulation passage P1 (see FIG. 12) may be provided such that air circulates between the tub 20 and the inside of the drying duct 40.

The drying duct 40 may be coupled to the second tub 22. A connection member 71 via which one end of the drying duct 40 is coupled to an opening 25 in the second tub 22 may be provided between the second tub 22 and the drying duct 40. That is, the connection member 71 may be located between the tub 20 and one end of the drying duct 40 through which air is introduced from the tub 20 into the drying duct 40.

A blowing fan 44 is located between the drying duct 40 and the tub 20. The blowing fan 44 defines a circulation flow of air such that air in the tub 20 may be introduced into the drying duct 40 and then be introduced into the tub 20 again. The drying duct 40 is equipped with a heater 45 to heat air therein. A bracket 46 may be provided by which the heater 45 is coupled to the drying duct 40.

The drying duct 40 may include an upper plate 41 and a lower plate 42. In addition, a head 43 may be located at an upper side of the blowing fan 44 in the opening 41*c* of the upper plate 41.

A suction member 50 to which the blowing fan 44 is seated may be located at a lower side of the drying duct 40. The suction member 50 will be described in detail later.

One side of the drying duct 40 is coupled with a front panel 21*a* extending from one side of the first tub 21. Thus, air circulates between the tub 20 and the drying duct 40.

The other side of the tub 20 may be coupled with a discharge member 60 to discharge wash water and air inside the tub 20. A connection member 72 may be coupled between the discharge member 60 and the tub 20, and may attenuate vibration and noise caused between the discharge member 60 and the tub 20.

The first hose 5 one side of which is connected to the drainage pump 4 is coupled to one side of the discharge member 60 and a second hose 6 is coupled to the other side of the discharge member 60 so as to discharge air or wash water to the outside of the cabinet 10. The discharge member 60 will be described in detail later.

When the drum 30 rotates and the blowing fan 44 operates during drying operation, air in the tub 20 is introduced into the drying duct 40. Air may circulate between the drying duct 40 and the tub 20 by repeating a process in which air heated in the drying duct 40 is introduced into the tub 20 again.

Figure 3:
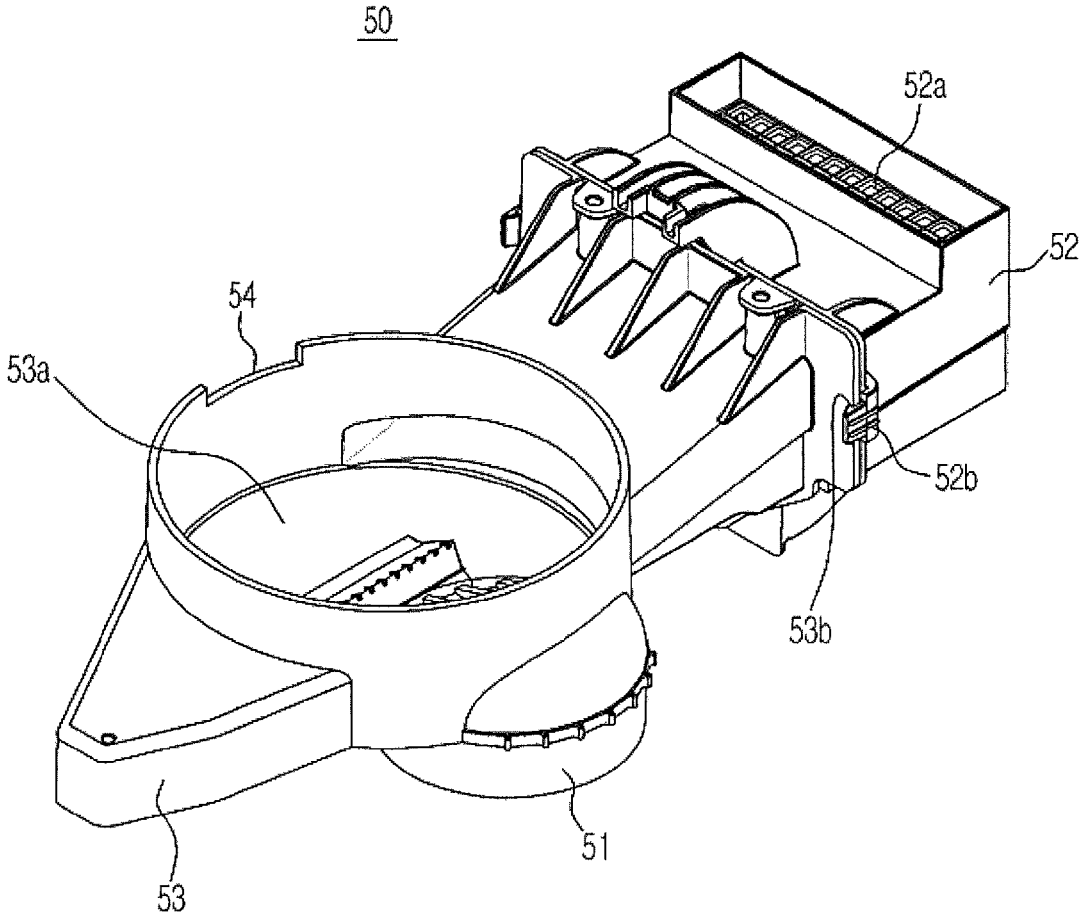
FIG. 3 is a view illustrating a suction member according to the embodiment of the present disclosure.
Figure 4:
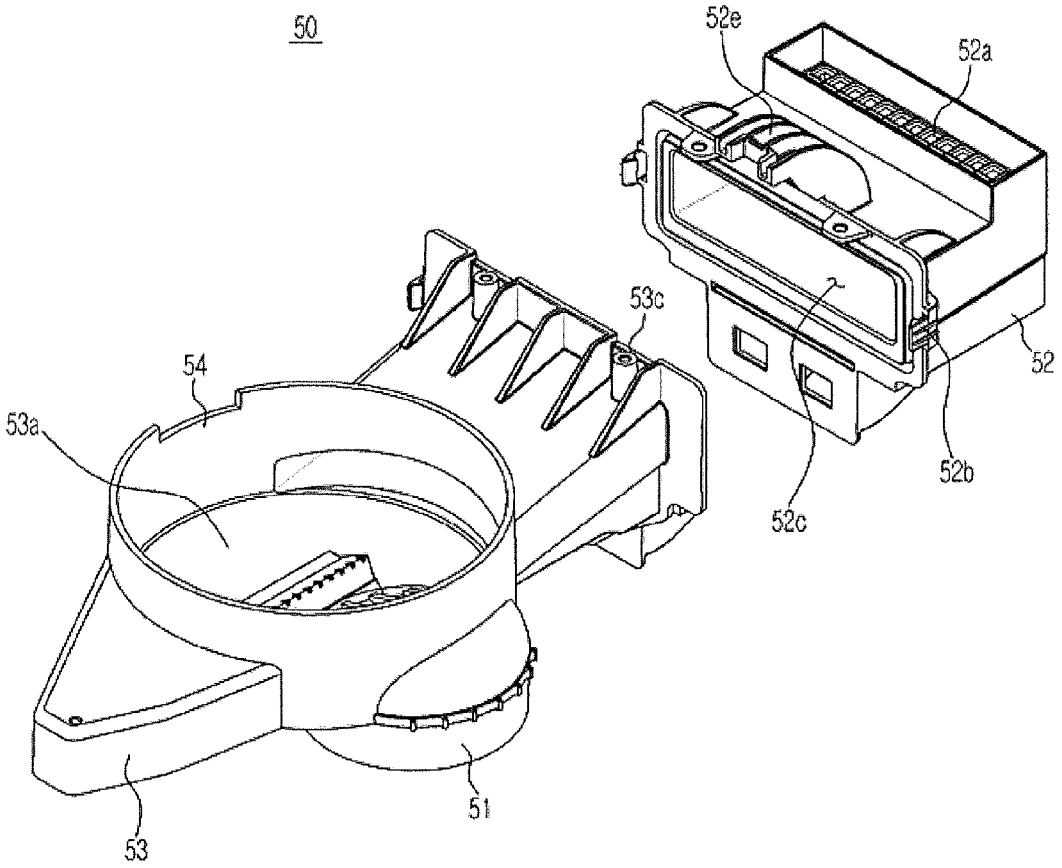
FIG. 4 is an exploded view illustrating the suction member according to the embodiment of the present disclosure.
Figure 5:
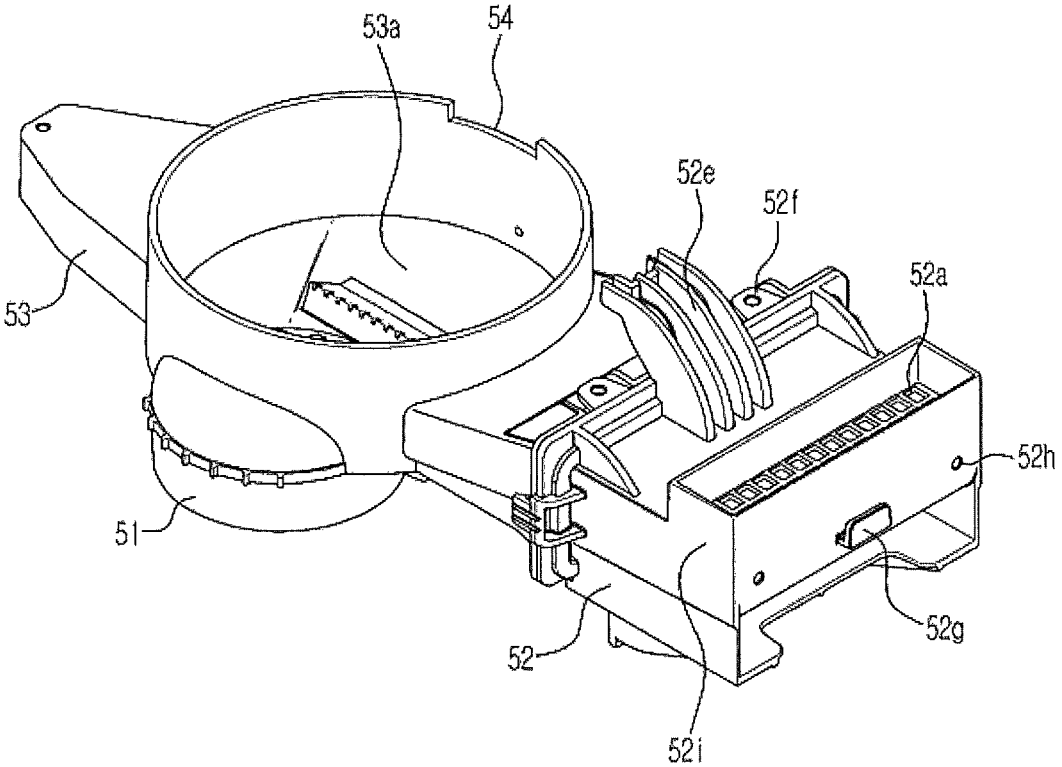
FIG. 5 is a view of the suction member according to the embodiment of the present disclosure when viewed from another angle.
Figure 6:
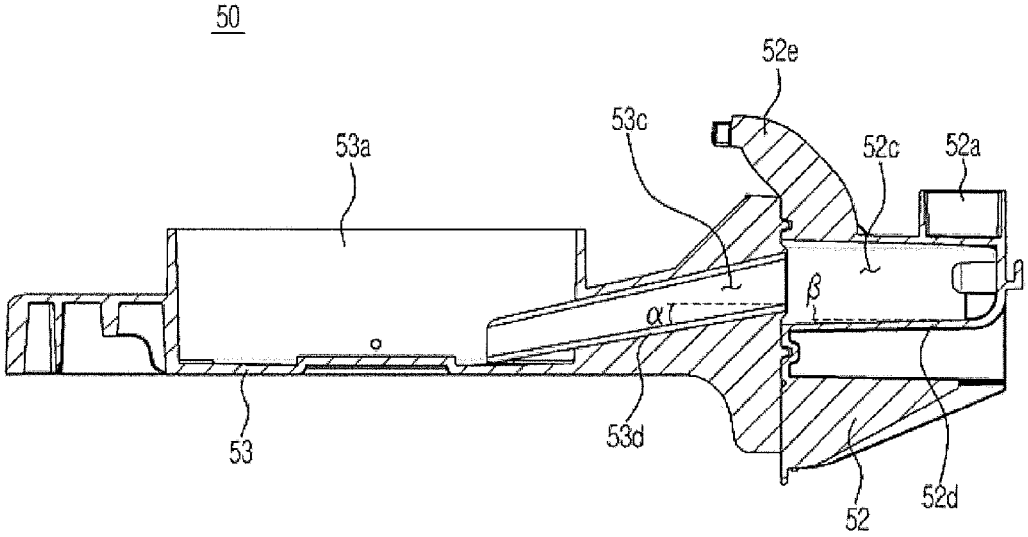
FIG. 6 is a cross-sectional view of the suction member according to the embodiment of the present disclosure.

FIG. 3 is a view illustrating the suction member according to the embodiment of the present disclosure. FIG. 4 is an exploded view illustrating the suction member according to the embodiment of the present disclosure. FIG. 5 is a view of the suction member according to the embodiment of the present disclosure when viewed from another angle. FIG. 6 is a cross-sectional view of the suction member according to the embodiment of the present disclosure.

As shown in FIGS. 3 to 6, the suction member 50 is provided with passages so as to suck air between the tub 20 and the cabinet 10. The suction member 50 may include a front member 53 located at the front thereof and a rear member 52 located at the rear thereof.

The front member 53 may be provided with a seating portion 53*a* to which the blowing fan 44 is seated. The seating portion 53*a* may communicate with the tub 20 and air condensed in the tub 20 may move to the seating portion 53*a* by operation of the blowing fan 44. At least a portion of the front member 53 may be provided with a slit 54 which is a passage so as to suck air outside the tub 20. The front member 53 may be formed, at a lower side thereof, with a front member communication port 51 to communicate with the tub 20.

The rear member 52 may be provided with inlets 52*a* to suck air between the tub 20 and the cabinet 10. As shown in the drawing, the inlets 52*a* are arranged on an upper side of the rear member 52 and enable air to be efficiently sucked in a direction of the blowing fan 44. In addition, since the inlets 52*a* are arranged on the upper side of the rear member 52, air only may be sucked besides bubbles. The upper side of the rear member 52 is provided with a support portion 52*e* to support the drying duct 40 with respect to the suction member 50. The support portion 52*e* may protrude upward to support an upper surface of the drying duct 40.

The front and rear members 53 and 52 are fastened to each other by at least one fastening portion. The fastening portion may include first fastening portions 52*b* and 53*b* which fasten the front and rear members 53 and 52 through hooks 52*b*. As shown in the drawing, although the hooks 52*b* provided at the rear member 52 are fastened to hook grooves 53*b* of the front member 53 such that the front and rear members 53 and 52 are coupled to each other, the present disclosure is not limited thereto. In addition, the fastening portion may include second fastening portions 52*f* and 53*f* which fasten the front and rear members 53 and 52 using a separate fastening member (not shown). The second fastening portions 52*f* and 53*f* may include a front member fastening hole 53*f* arranged at the front member 53 and a rear member fastening hole 52*f* arranged at the rear member 52. The rear member fastening hole 52*f* has a shape corresponding to a shape of the front member fastening hole 53*f*. That is, the fastening member (not shown) is inserted through the rear member fastening hole 52*f* into the front member fastening hole 53*f* to couple the front member 53 to the rear member 52. In this case, the first fastening portions 52*b* and 53*b* temporarily fix the front and rear members 53 and 52 and the front and rear members 53 and 52 are coupled to each other by the second fastening portions 52*f* and 53*f*.

The insides of the front and rear members 53 and 52 may be provided with passages in which air sucked through the inlets 52*a* moves. The passage provided in the rear member 52 is defined as a first passage and the passage provided in the front member 53 is defined as a second passage. The first passage is defined by a rear member communication port 52*c* arranged inside the rear member 52 and the second passage is defined by a front member communication port 53*c* arranged inside of the front member 53.

At least one of the front and rear members 53 and 52 may include an inclined portion 52*d* or 53*d* a bottom of which is inclined. The inclined portion 52*d* or 53*d* may be inclined in the direction of the blowing fan 44 to guide movement of air. The inclined portion 52*d* or 53*d* may be inclined by an angle of 1° to 20° with respect to the plane. As shown in the drawing, although the inclined portion 53*d* arranged at the front member 53 is inclined by an angle $\alpha$ of 15° with respect to the plane and the inclined portion 52*d* arranged at the rear member 52 is inclined by an angle $\beta$ of 1° with respect to the plane, the present disclosure is not limited thereto. This enables wash water in the tub to be prevented from overflowing from the tub by flowing backward.

As described above, the passages are arranged such that air may be sucked into the suction member 50 coupled to the lower side of the drying duct 40, so as to be capable of sucking air between the cabinet 10 and the tub 20. Since air outside the tub 20 has relatively low humidity compared with air inside the tub 20, condensation efficiency may be enhanced. In addition, it may be possible to reduce a drying time because of being capable of drying laundry using such air. In addition, it may be possible to more efficiently wash laundry since external air is introduced through the inlets 52*a* of the suction member 50.

In addition, a fixing portion may be provided in at least a portion of the rear member 52 in order to fix the suction member 50 to the cabinet 10. The fixing portion may include a first fixing portion 52*g* which fix the suction member 52 to the cabinet 10 by coupling a hook 52*g* provided at the rear of the rear member 52 to a hook groove (not shown) of the cabinet 10. In addition, the fixing portion may include second fixing portions 52*h* to fix the suction member 52 to the cabinet 10 using separate fastening members (not shown). The second fixing portions 52*h* may include fixing holes (not shown) formed at the rear surfaces of the rear member 50 and the cabinet 10. The first fixing portion 52*g* is provided for temporary fixing, and the cabinet 10 and the suction member 50 are coupled to each other by coupling the fastening members (not shown) to the second fixing portions 52*h*.

Figure 7:
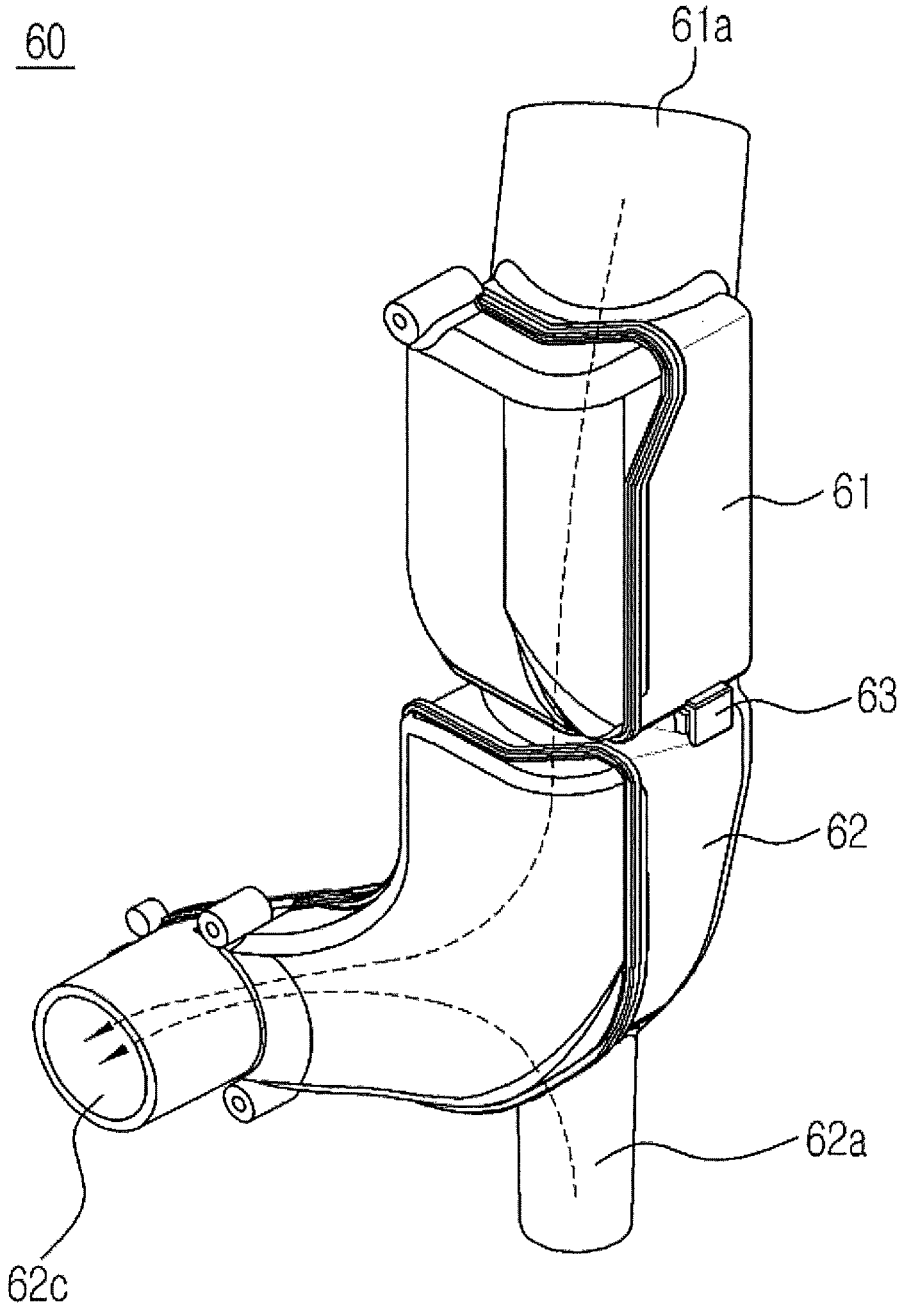
FIG. 7 is a view illustrating a discharge member according to the embodiment of the present disclosure.
Figure 8:
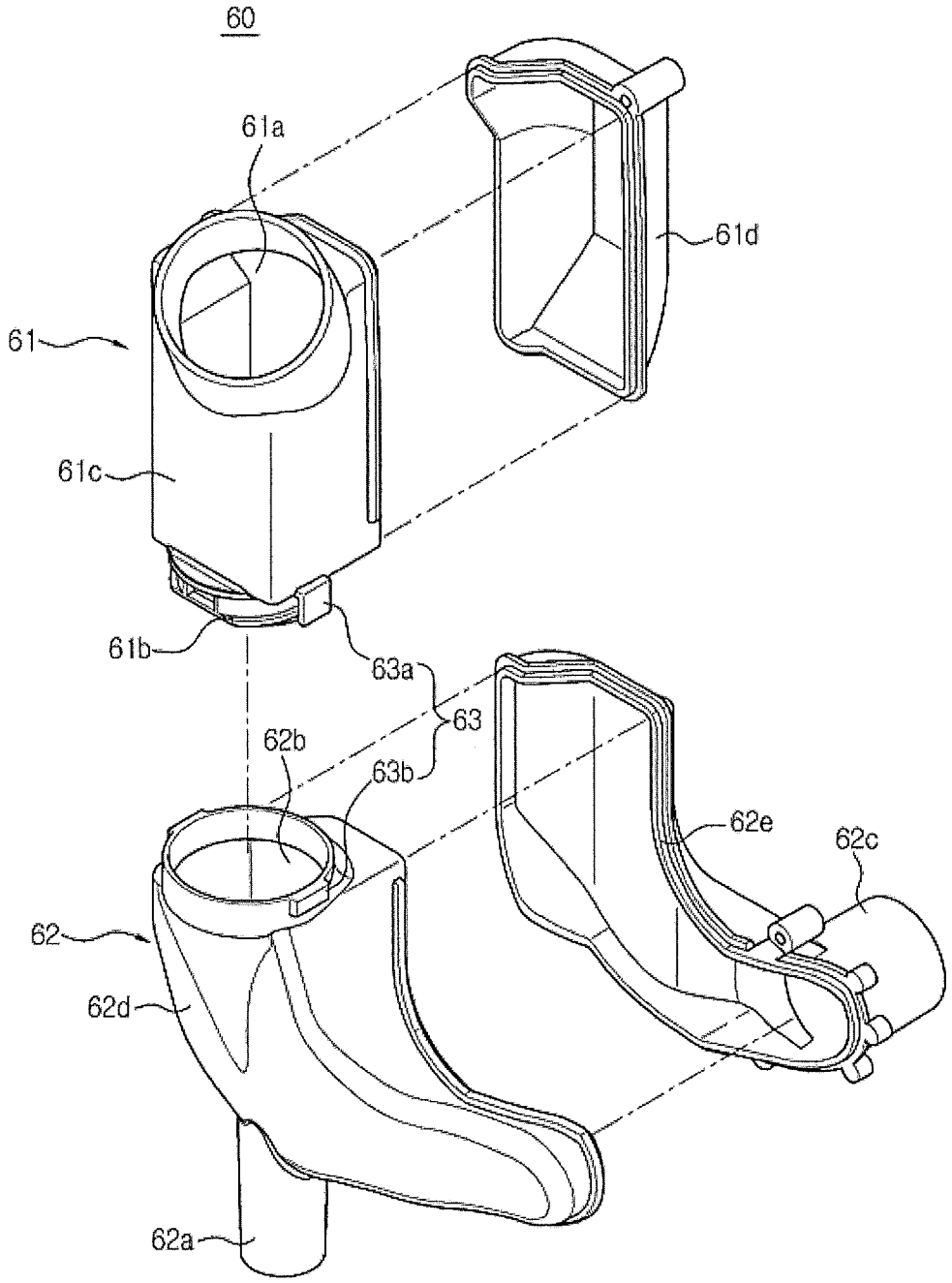
FIG. 8 is an exploded view illustrating the discharge member according to the embodiment of the present disclosure.
Figure 9:
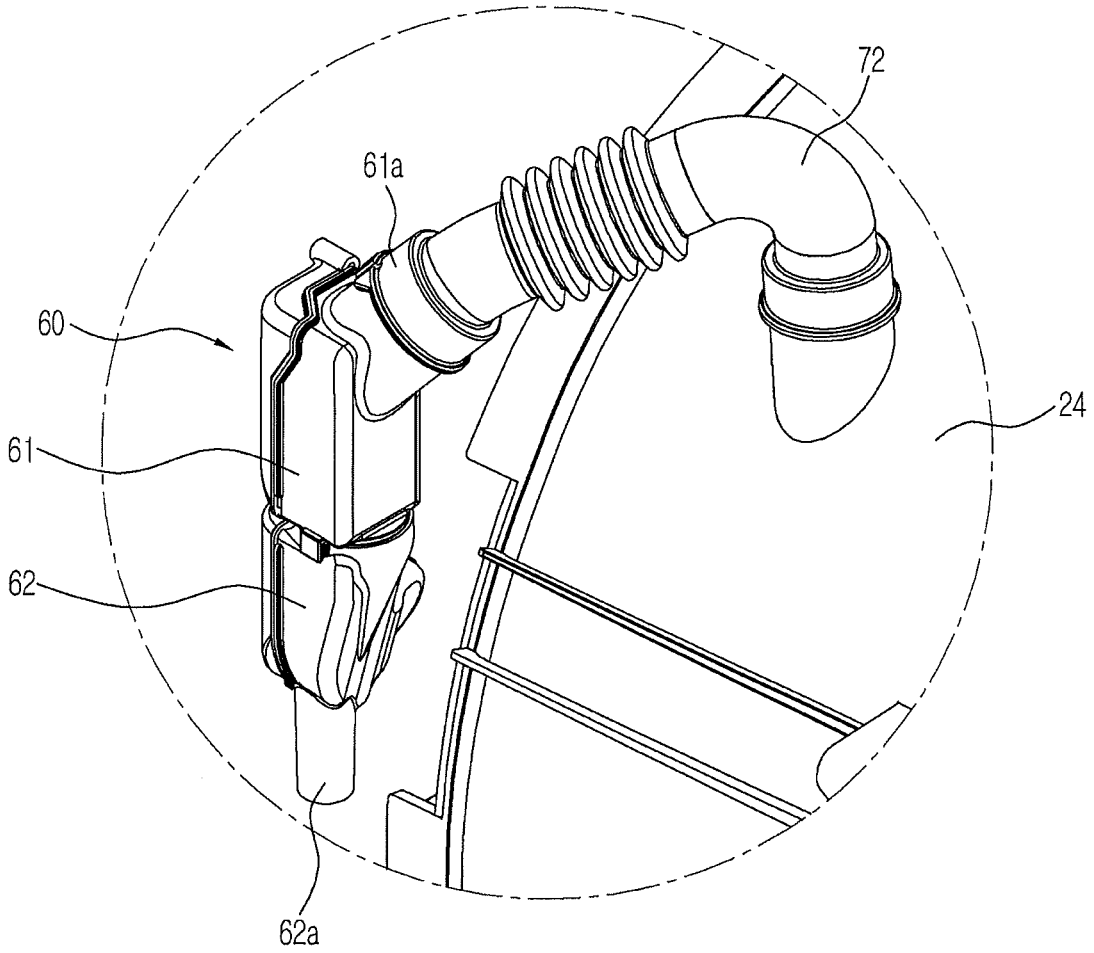
FIG. 9 is an enlarged view illustrating a state in which the discharge member according to the embodiment of the present disclosure is coupled to a tub.
Figure 10:
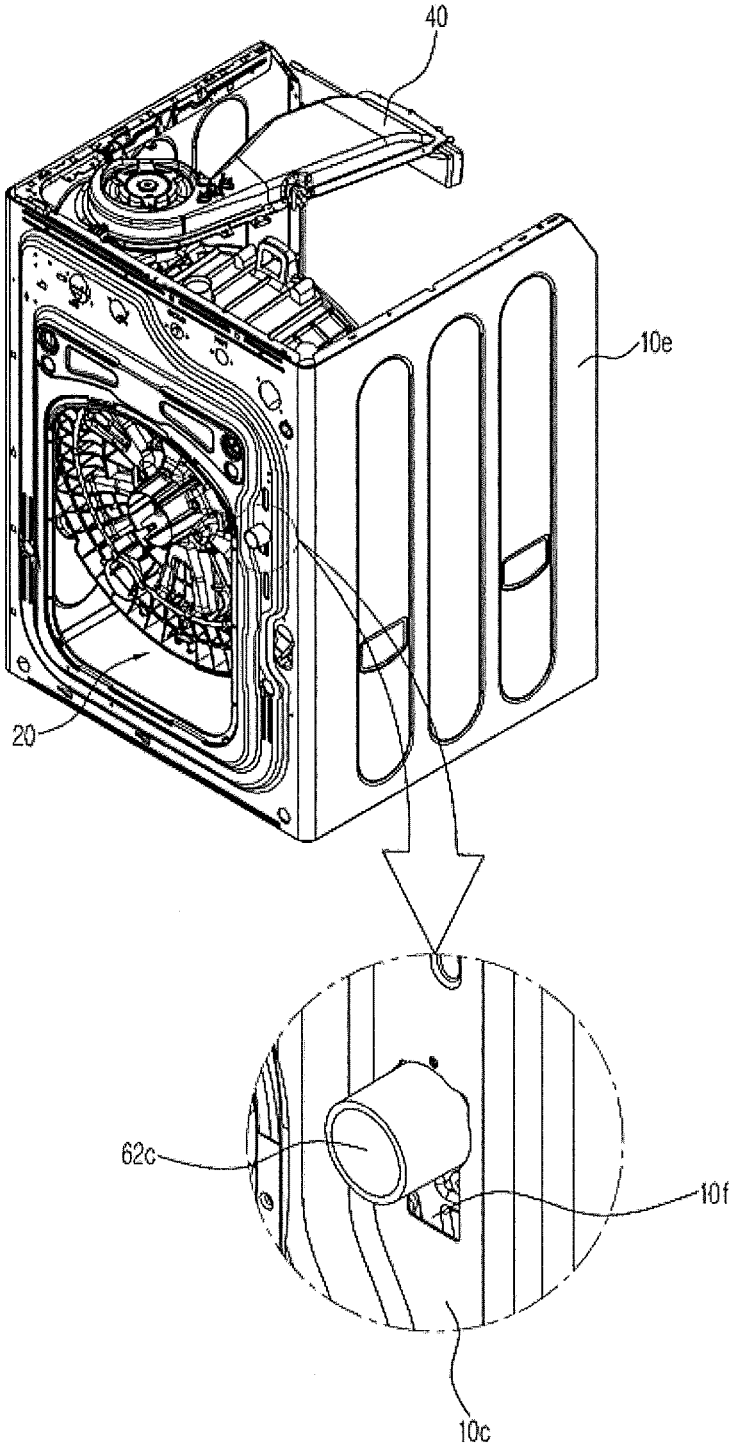
FIG. 10 is a view illustrating the rear of the drum washing machine according to the embodiment of the present disclosure.

FIG. 7 is a view illustrating the discharge member according to the embodiment of the present disclosure. FIG. 8 is an exploded view illustrating the discharge member according to the embodiment of the present disclosure. FIG. 9 is an enlarged view illustrating a state in which the discharge member according to the embodiment of the present disclosure is coupled to a tub. FIG. 10 is a view illustrating the rear of the drum washing machine according to the embodiment of the present disclosure.

As shown in FIGS. 7 to 10, the discharge member 60 may include a first introduction port 61*a* through which humid air in the tub 20 is introduced and a second introduction port 62*a* through which wash water is introduced. As shown in the drawings, the first introduction port 61*a* is located at an upper side of the discharge member 60 and the second introduction port 62*a* is located at a lower side of the discharge member 60. This enables wash water and air to be easily discharged using a difference in specific gravities of wash water and air.

In addition, the discharge member 60 may be provided, at the other side thereof, with a discharge port 62*c* through which at least one of air and wash water is discharged. The discharge port 62*c* may be located between the first introduction port 61*a* and the second introduction port 62*a*.

The discharge member 60 may be provided therein with a first passage through which air in the tub 20 is introduced and discharged and a second passage through which wash water in the tub 20 is introduced and discharged. The first and second passages may share the discharge port 62*c*.

In accordance with the embodiment of the present disclosure, the discharge member 60 may include a first discharge member 61 and a second discharge member 62. The first introduction port 61*a* is disposed at an upper side of the first discharge member 61 and the second introduction port 62*a* is disposed at a lower side of the second discharge member 62. In addition, the other side of the first discharge member 61 is provided with a first communication hole 61*b* so as to communicate with the second discharge member 62. The other side of the second discharge member 62 is also provided with a second communication hole 62*b* so as to communicate with the first discharge member 61. Although the second discharge member 62 is formed with the discharge port 62*c* according to the embodiment of the present disclosure, the present disclosure is not limited thereto. One discharge member 60 is constituted by coupling the first and second discharge members 61 and 62.

The first and second discharge members 61 and 62 are coupled by a discharge member coupling portion 63. As shown in the drawing, the discharge member coupling portion 63 is provided in a hook manner. Although the first discharge member 61 is provided with a hook 63*a* and the second discharge member 62 is provided with a coupling groove 63*b*, the present disclosure is not limited thereto. For example, it is inversely possible. The first and second discharge members 61 and 62 are coupled by the discharge member coupling portion 63, and air or wash water move through the first and second communication holes 61*b* and 62*b*.

The discharge port 62 of the discharge member 60 may protrude outward of the cabinet 10. The discharge port 62*c* may be coupled to a coupling hole 10*f* formed at the cabinet 10 to communicate with the outside of the cabinet 10. Thus, air or wash water introduced into the discharge member 60 may be discharged. The coupling hole 10*f* may be located at a point which is two-thirds from the bottom of the cabinet 10.

The discharge member 60 may have a cross-sectional area larger than that of the discharge port 62*c*. For example, the cross-sectional area of the discharge member 60 may be at least 800 $mm^2$.

The first discharge member 61 may include a first front discharge member 61*c* located at the front thereof and a first rear discharge member 61*d* located at the rear thereof. Similarly, the second discharge member 62 may include a second front discharge member 62*d* located at the front thereof and a second rear discharge member 62*e* located at the rear thereof.

The first introduction port 61*a* may be provided at the first front discharge member 61*c*. As shown in the drawing, although the second introduction port 62*a* is provided at the front discharge member 62*d* and the discharge port 62*c* is provided at the second rear discharge member 62*e*, the present disclosure is not limited thereto.

The first front discharge member 61*c* and the first rear discharge member 61*d* may be coupled by bonding thereof and the second front discharge member 62*d* and the second rear discharge member 62*e* may be coupled by bonding thereof. For example, these are coupled by ultrasonic bonding or thermal bonding. That is, after the respective front discharge members 61*c* and 62*d* and the respective rear discharge members 61*d* and 62*e* are coupled to each other, one discharge member 60 is constituted by coupling of the first and second discharge members 61 and 62. The first passage is formed by coupling of the first front and rear discharge members 61*c* and 61*d* and the second passage is formed by coupling of the second front and rear discharge members 62*d* and 62*e*.

Figure 11A:
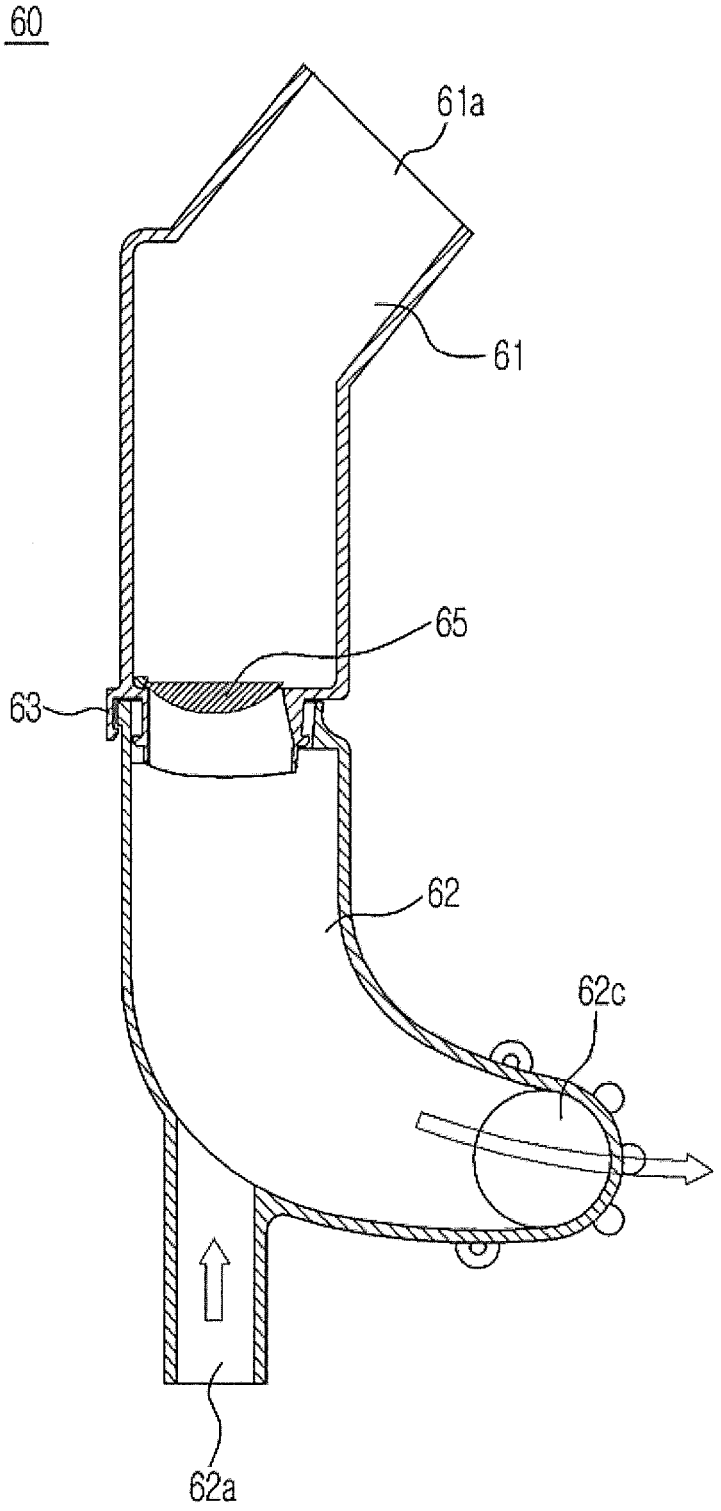
FIGS. 11A and 11B are cross-sectional views of the discharge member according to the embodiment of the present disclosure.
Figure 11B:
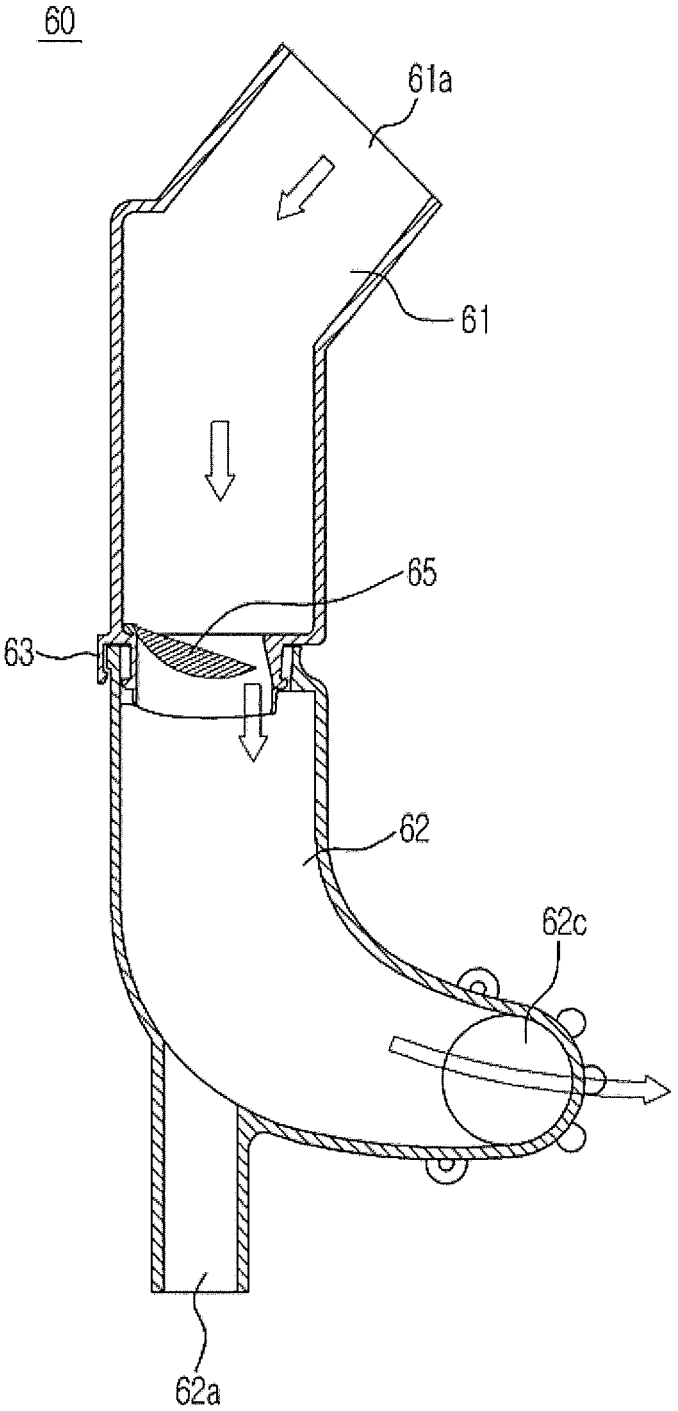

FIGS. 11A and 11B are cross-sectional views of the discharge member according to the embodiment of the present disclosure.

FIG. 11A is a view illustrating a case in which wash water is discharged from the discharge member 60 according to the embodiment of the present disclosure and FIG. 11B is a view illustrating a case in which air is discharged from the discharge member 60 according to the embodiment of the present disclosure.

An opening and closing member 65 may be located between the first and second discharge members 61 and 62 and serve to open and close the passage of air introduced from the first introduction port 61*a*. One side of the opening and closing member 65 is coupled to at least one of the first and second discharge members 61 and 62, but the other side thereof is provided to have motion in a state of being not coupled to anyone. In accordance with the embodiment of the present disclosure, the opening and closing member 65 may be made of a rubber material having flexibility.

As shown in FIG. 11A, the opening and closing member 65 closes the passage of air, and wash water introduced from the second introduction port 62*a* moves in an arrow direction to be discharged from the discharge port 62*c*. That is, the discharged wash water pushes the opening and closing member 65, thereby closing the passage.

As shown in FIG. 11B, the opening and closing member 65 moves downward by pressure of air introduced from the first introduction port 61*a*, thereby opening the passage of air. Thus, air is moved and discharged from the discharge port 62*c*.

However, when the discharge port 62*c* is located at a position lower than a predetermined height, air and wash water may be simultaneously discharged since force by which wash water pushes the opening and closing member 65 is small.

In addition, as shown in the drawing, although the opening and closing member 65 is provided in a membrane shape according to the embodiment of the present disclosure, the present disclosure is not limited thereto. For example, the opening and closing member 65 may also be provided in a ball shape in order to use the buoyancy of the wash water.

In accordance with the embodiment of the present disclosure, during drying operation of the drum washing machine 1, air which is hot and humid by absorbing moisture in laundry may be discharged outside the drum washing machine 1. Since hot and humid air is discharged outside the drum washing machine 1 and external air having low humidity is introduced into the tub 20 through the suction member 50, condensation efficiency of air may be enhanced and thus condensation water need not be supplied. In addition, since drainage of wash water and air is performed by one member, it may be possible to efficiently utilize a space. In addition, since the conventional condensation duct is located at the rear of the tub, there is a limit to increase a receiving capacity of laundry because the size of the tub 20 may not be increased within a given space. However, according to the present disclosure, since the condensation duct is not present, it may be possible to utilize a space in which the existing condensation duct is located. Consequently, it may be possible to increase a receiving capacity of laundry by increasing the size of the tub 20 while decreasing or maintaining the overall size of the drum washing machine 1.

Figure 12:
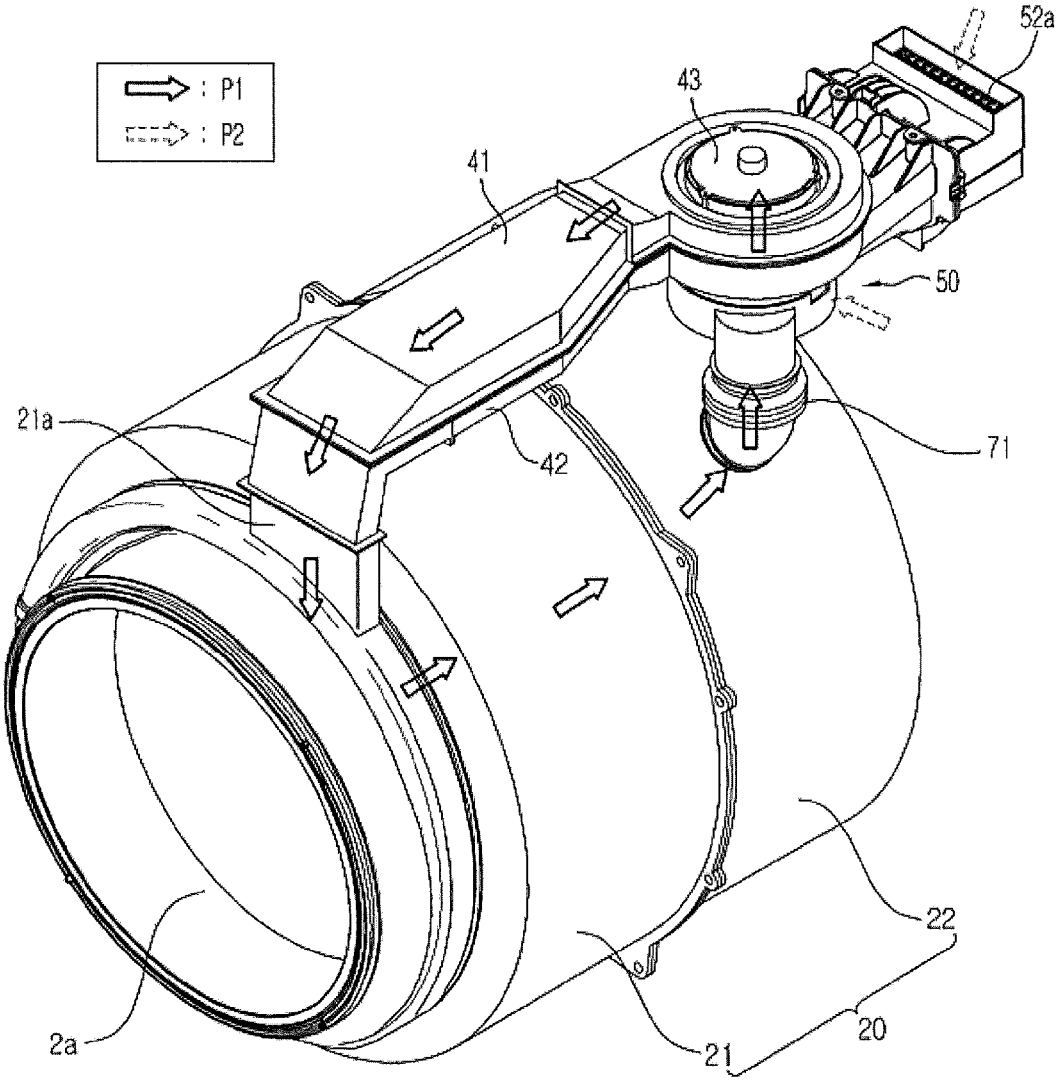
FIG. 12 is a view illustrating an air flow of the drum washing machine according to the embodiment of the present disclosure.

FIG. 12 is a view illustrating an air flow of the drum washing machine according to the embodiment of the present disclosure.

Hereinafter, referring to FIG. 12, a description will be given of an air flow of the drum washing machine according to the embodiment of the present disclosure. Reference numeral P1 refers to a circulation passage P1 provided such that air circulates between the tub 20 and the inside of the drying duct 40, and reference numeral P2 refers to a flow of air introduced from the outside of the tub 20.

Laundry is dried by air circulating within the tub 20 while being tumbled within the drum 30 (see FIG. 1). Hot and humid air absorbing moisture contained in laundry within the drum 30 (see FIG. 1) passes through the suction member 50 through the connection member 71 and is then introduced into the drying duct 40. That is, during drying operation, hot and humid air is condensed by removal of moisture therein via a process in which hot and humid air absorbing moisture in laundry is introduced into the drying duct 40 by operation of the blowing fan 44, is heated, and is introduced into the tub 20 again.

Meanwhile, dry air outside the tub 20 may be introduced into the suction member 50 through the slit 54 by operation of the blowing fan 44. In addition, dry air outside the tub 20 is introduced into the suction member 50 through the inlets 52*a* of the suction member 50 and the introduced air is introduced into the drying duct 40 via the rear and front members 53 and 52. Due to an air introduction structure of the suction member 50, external dry air may be additionally introduced into the drying duct and condensation may be generated by the introduced dry air, thereby enhancing condensation efficiency. In this case, the present disclosure has an advantage of being capable of condensing hot and humid air without using wash water for condensation (hereinafter, referred to as "condensation water"). In the related art, condensation water has to be continuously supplied in order to condense hot and humid air absorbing moisture in laundry. However, according to the embodiment of the present disclosure, air generated during drying operation may be condensed by external air without using condensation water. Thus, condensation efficiency may be enhanced and at the same time a use amount of water may be reduced since condensation water is not used. Therefore, the present disclosure is eco-friendly. In a case of introducing external air through the suction member 50 and simultaneously using condensation water during drying operation, condensation efficiency may be further enhanced, compared with an existing method. In addition, as another example, the drum washing machine may have an air wash function to introduce external air into the drum. In a case of having the air wash function, it may be possible to remove moisture in hot and humid air for a short time by additionally introducing external air using the air wash function during drying operation. In addition, external fresh air is introduced through the inlets 52*a* of the suction member 50 during air wash operation, thereby enabling laundry to be washed with more cleanliness.

Condensation water or air condensed by dry air is heated by the heater 45 (see FIG. 2) inside the drying duct 40 while passing through the drying duct 40. The heated air is introduced into the tub 20 via the drying duct 40 and the front panel 21*a* extending from one side of the first tub 21 so as to remove moisture contained in laundry within the drum 30 and dry the laundry.

In addition, humid air after drying is discharged to the outside of the cabinet 10 through the discharge member 60 coupled to the other side of the first tub 21.

Hereinafter, a simple description will be given of washing, rinse, dehydration, drying operations of the drum washing machine according to the embodiment of the present disclosure.

When the washing operation begins after laundry is inserted into the drum 30, wash water supplied through the second water supply tube 13 is supplied into the tub 20 and the drum 30 together with detergent via the detergent supply unit 12.

When the supply of wash water is completed, washing is performed while the drum 30 is rotated by the motor 7 which is installed at the rear outside of the tub 20 and may rotate the drum 30.

When the washing operation is completed, the rinse operation begins while wash water is supplied to the tub 20. After the rinse operation is completed, the dehydration operation is performed.

After the dehydration operation, the drying operation begins. During the drying operation, the blowing fan 44 operates and thus humid air inside the drum 30 is condensed within the tub 20 to be dried within the drying duct 40. During the drying operation, dry air outside the tub 20 may be additionally introduced through the inlets 52*a* of the suction member 50 by operation of the blowing fan 44, so that it may possible to reduce a condensation time of hot and humid air absorbing moisture in laundry.

During the drying operation, humid air may be discharged to the outside through the discharge port 62*c* of the discharge member 60. Accordingly, it may be possible to discharge humid air absorbing moisture in laundry through the discharge member 60 and introduce external dry air through the suction member 50. Therefore, the present disclosure is economical because of being capable of reducing a use amount of water without a need to use condensation water. Even though condensation water is partially used in order to condense hot and humid air, condensation water need not be continuously supplied as the related art.

Figure 13:
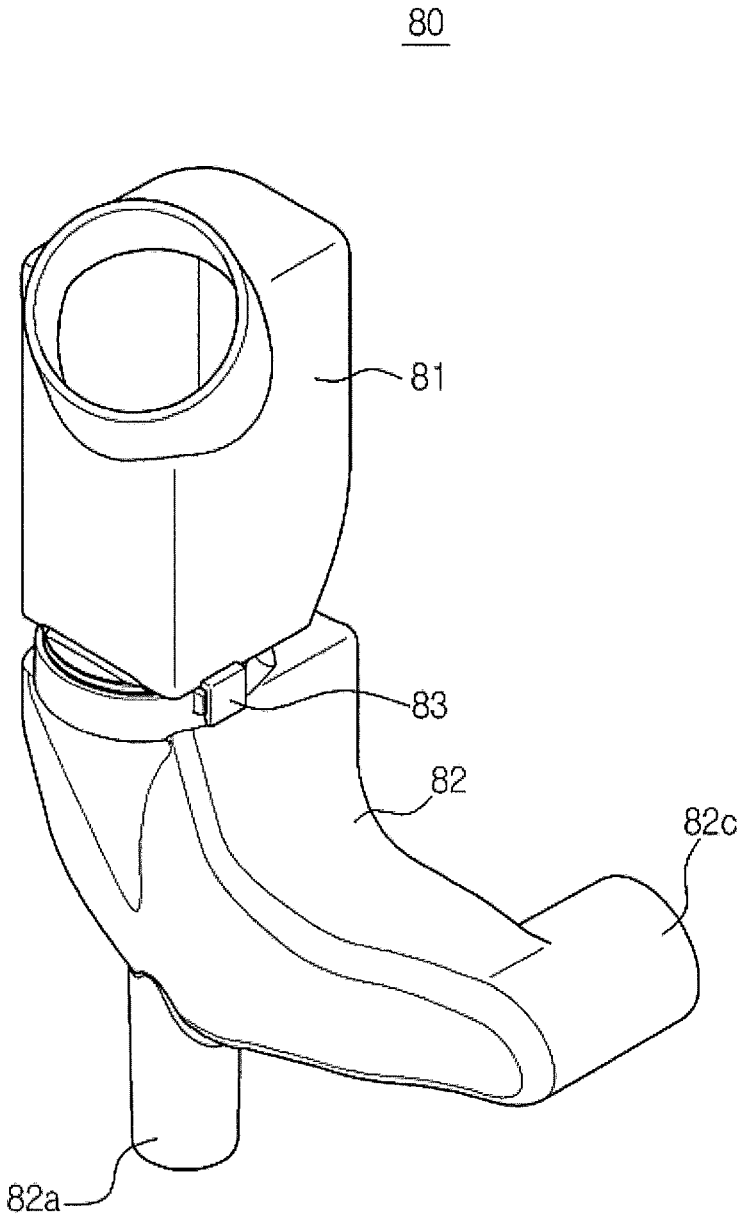
FIG. 13 is a view illustrating a discharge member according to another embodiment of the present disclosure.
Figure 14:
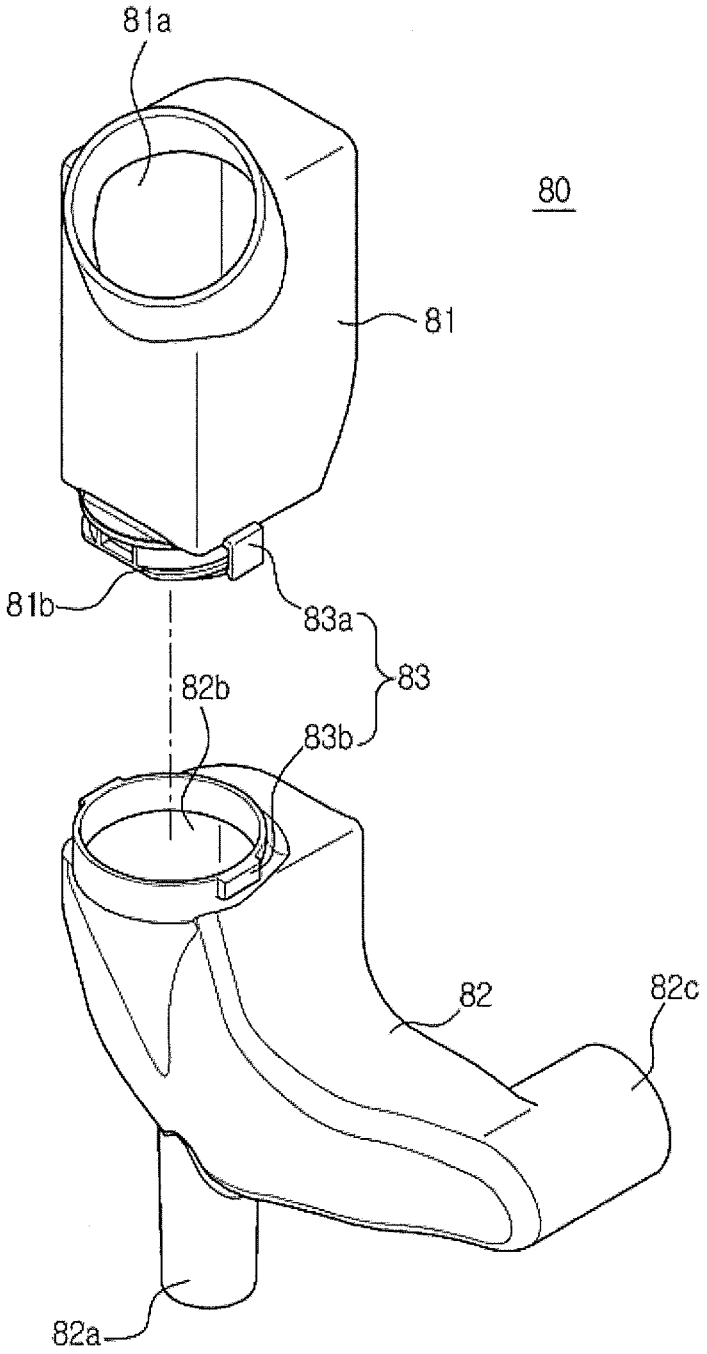
FIG. 14 is an exploded view illustrating the discharge member according to another embodiment of the present disclosure.

FIG. 13 is a view illustrating a discharge member according to another embodiment of the present disclosure. FIG. 14 is an exploded view illustrating the discharge member according to another embodiment of the present disclosure.

As shown in FIGS. 13 and 14, each of a first discharge member 81 and a second discharge member 82 constituting a discharge member 80 may be integrally formed by injection molding.

A first introduction port 81*a* and a first communication hole 81*b* of the first discharge member 81 may be formed by blow molding. That is, the first introduction port 81*a* and the first communication hole 81*b* are formed by injecting resin to be a material of the first discharge member 81 into a mold and blowing air thereinto during injection molding of the first discharge member 81.

Similarly, a second communication hole 82*b*, a second introduction port 82*a*, and a discharge port 82*c* of the second discharge member 82 may be formed by blow molding. That is, the second communication hole 82*b*, the second introduction port 82*a*, and the discharge port 82*c* are formed by injecting resin to be a material of the second discharge member 82 into a mold and blowing air thereinto during injection molding of the second discharge member 82. That is, a first passage in which air in a tub moves and a second passage in which wash water moves are formed by blowing molding.

In a case of injection molding of the first and second discharge members 81 and 82 using blow molding, since each of the first and second discharge members 81 and 82 is provided as one member, a separate process for coupling such as bonding is not required.

Figure 15A:
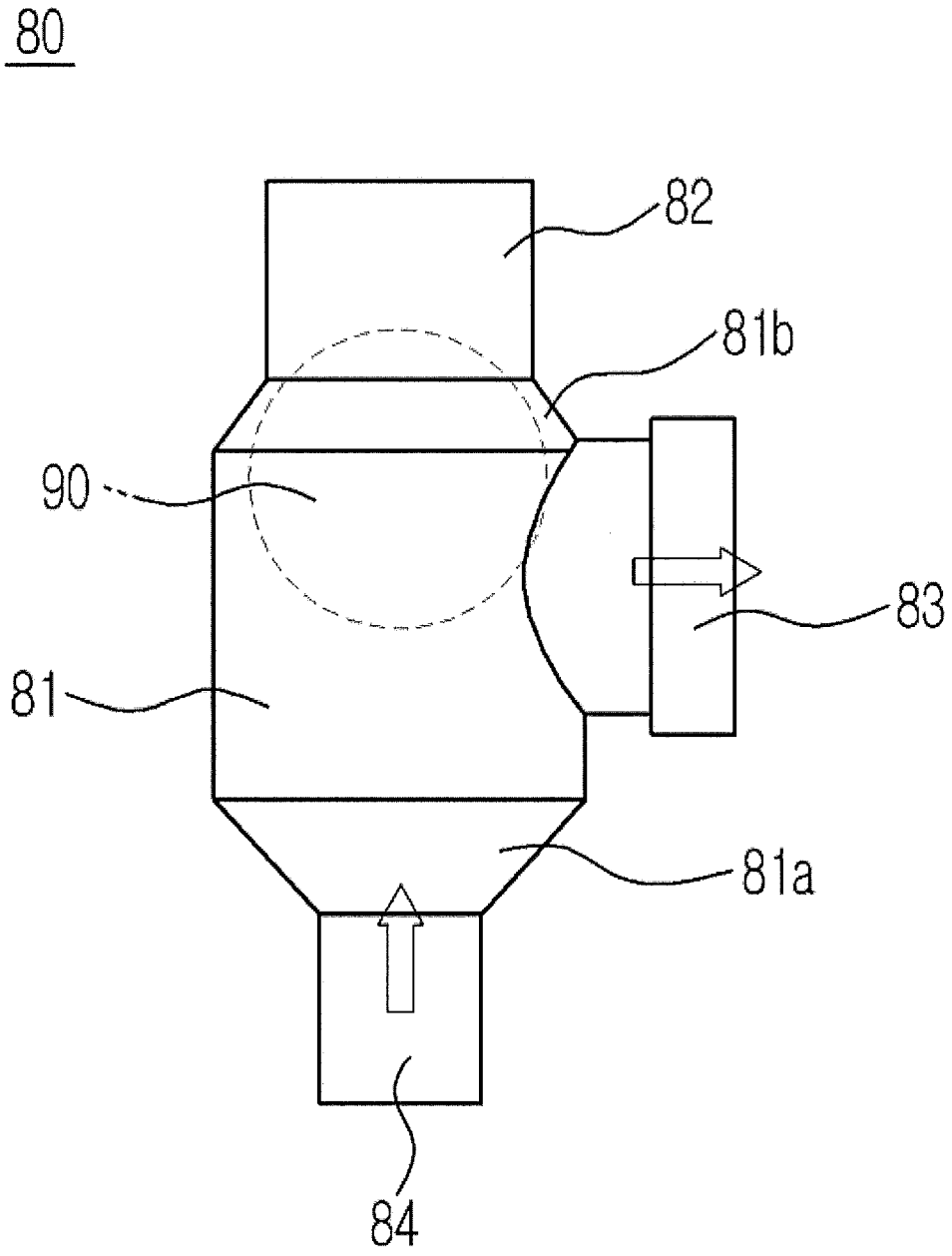
FIGS. 15A and 15B are cross-sectional views of a discharge member according to a further embodiment of the present disclosure.
Figure 15B:
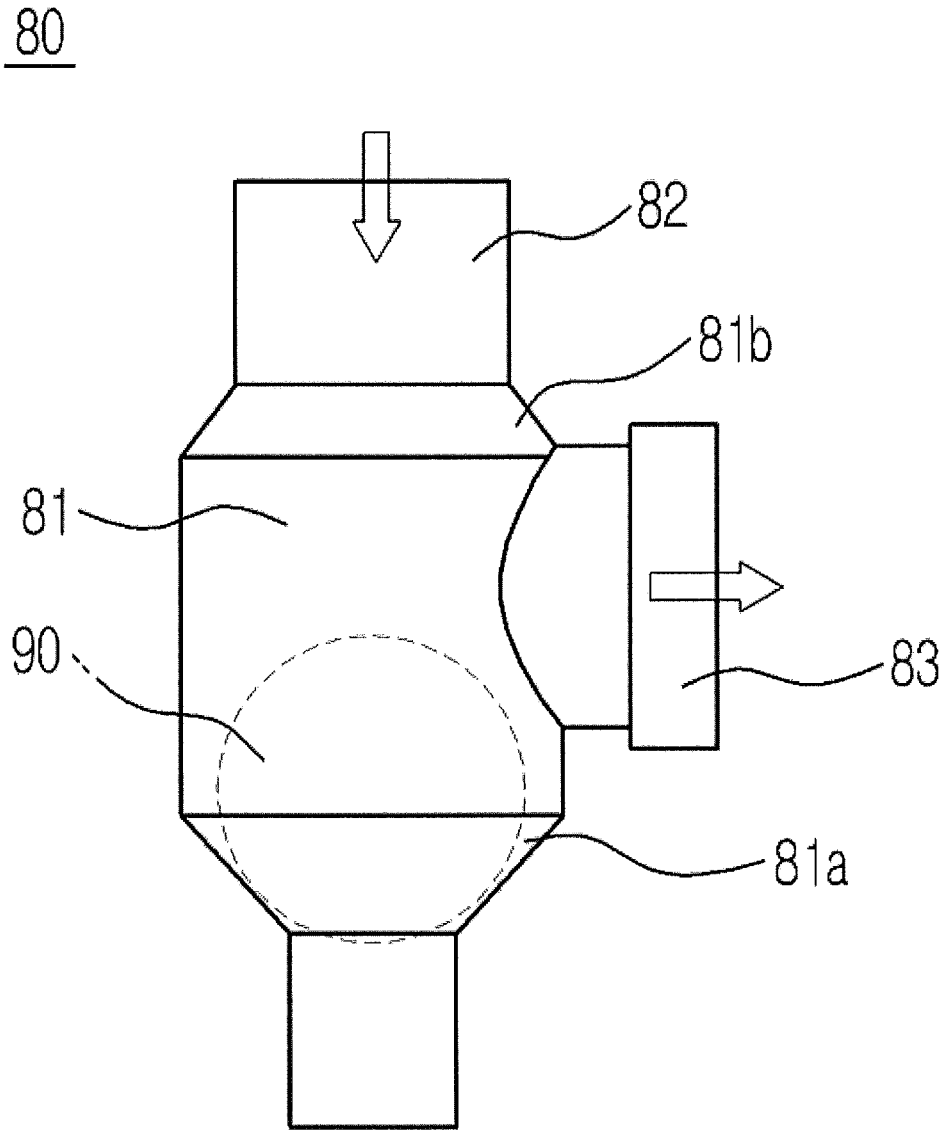

FIGS. 15A and 15B are cross-sectional views of a discharge member according to a further embodiment of the present disclosure.

FIG. 15A is a view illustrating a case in which wash water is discharged from a discharge member 80 according to the embodiment of the present disclosure and FIG. 15B is a view illustrating a case in which air is discharged from the discharge member 80 according to the embodiment of the present disclosure.

The embodiment of the present disclosure shown in FIGS. 15A and 15B is the same as that shown in FIGS. 11A and 11B in that a first introduction port 82 through which air is introduced, a second introduction port 84 through which wash water is introduced, and a discharge port 83 through which air and wash water are discharged are provided.

In accordance with the embodiment of the present disclosure, the discharge member 80 includes an opening and closing member 90 as a buoyancy valve which may open and close the passage of air by buoyancy. The opening and closing member 90 may be provided in a ball shape of less specific gravity than wash water.

The discharge member 80 includes a discharge member body 81 located between the first and second introduction ports 82 and 84. Upper and lower sides of the discharge member body 81 may be respectively provided with a first region 81*a* and a second region 81*b* which have a smaller diameter than that of the opening and closing member 90 in order to prevent the opening and closing member 90 from deviating from the first and second introduction ports 82 and 84. That is, the opening and closing member 90 is movable between the first region 81*a* and the second region 81*b*.

As shown in FIG. 15A, wash water is introduced through the second introduction port 84 and the opening and closing member 90 having less specific gravity than wash water moves upward due to introduction of wash water. Thus, the opening and closing member 90 closes the passage of air. Wash water introduced from the second introduction port 84 moves in an arrow direction to be discharged from the discharge port 83.

As shown in FIG. 15B, due to pressure of air introduced from the first introduction port 82 and drainage of wash water, the opening and closing member 90 moves downward to open the passage of air. Thus, air moves and is discharged from the discharge port 83.

As is apparent from the above description, a drum washing machine according to the present disclosure may enhance condensation efficiency by improving an air circulation structure thereof and reduce a drying time.

In addition, since the drum washing machine is easily manufactured and an installation space of a condensation duct is reduced by unifying a member to discharge air and a member to discharge wash water, a receiving capacity of laundry may be increased without an increase in size of a cabinet.

In addition, the drum washing is economical because of being capable of condensing air without the use of condensation water.

Furthermore, it may be possible to simultaneously increase a circulation rate of air and condensation efficiency by additionally introducing external air due to inlets.

Although a few embodiments of the present disclosure have been shown and described, it would be appreciated by those skilled in the art that changes may be made in these embodiments without departing from the principles and spirit of the invention, the scope of which is defined in the claims and their equivalents.

What is claimed is:

1. A drum washing machine comprising:

a cabinet;

a tub arranged within the cabinet;

a drum rotatably arranged within the tub;

a drying unit which heats and circulates air discharged from the tub so as to dry laundry within the drum, the drying unit comprising a drying duct equipped with a heater to heat air therein, a circulation passage provided such that air circulates between the tub and the inside of the drying duct, and a suction member which is coupled to one side of the drying duct and introduces air outside the tub onto the circulation passage; and a discharge member coupled to an upper side of the tub and discharges part of the air and wash water in the tub to the outside of the cabinet, wherein the discharge member comprises a first discharge member having a first introduction port through which air in the tub is introduced, and a first communication hole disposed at an opposite side of the first introduction port;

a second discharge member having a second introduction port through which wash water is introduced, a second communication hole coupled to the first communication hole, and a discharge port through which the air and wash water are discharged; and an opening and closing member disposed between the first communication hole and the second communication hole to open or close a passage between the first discharge member and the second discharge member such that air introduced from the first introduction port passes through the second communication hole while the wash water introduced from the second introduction port is prevented from passing through the first communication hole.

2. The drum washing machine according to claim 1, wherein the suction member is provided with at least one inlet such that a passage into which air is sucked from an upper side of the inlet is formed in order to suck air outside the tub.

3. The drum washing machine according to claim 2, wherein the suction member comprises a front member to which a blowing fan to circulate air in the tub is seated and a rear member provided with the inlet.

4. The drum washing machine according to claim 3, wherein the rear member comprises a rear communication port through which air sucked into the inlet moves, and the front member comprises a front communication port through which air sucked into the rear member moves.

5. The drum washing machine according to claim 1, wherein the discharge port of the discharge member is coupled to a coupling hole of the cabinet so as to protrude outward of the cabinet.

6. The drum washing machine according to claim 5, wherein the coupling hole of the cabinet coupled with the discharge port of the discharge member is located at a point which is two-thirds from the bottom of the cabinet.

7. The drum washing machine according to claim 1, wherein the opening and closing member is provided in a membrane shape so as to be capable of opening and closing the passage of air by pressure of air.

8. The drum washing machine according to claim 1, wherein the opening and closing member is provided as a buoyancy valve capable of opening and closing the passage of air using buoyancy generated by wash water.

9. The drum washing machine according to claim 3, wherein at least a portion of the front member is provided with a slit for suction of external air.

10. A drum washing machine to perform a drying function, comprising:

a cabinet;

a tub arranged within the cabinet;

a drum rotatably arranged within the tub;

a drying duct to heat and supply air into the tub; and a discharge member coupled to an upper side of the tub to discharge wash water and air in the tub to the outside of the cabinet, wherein the discharge member comprises a first discharge member having an air inlet through which air in the tub is introduced, and a first communication hole to discharge the air in the first discharge member;

a second discharge member having a water inlet through which wash water contained in the tub is introduced, a second communication hole coupled to the first communication hole, and a discharge port through which the air and wash water are discharged; and an opening and closing member disposed between the first communication hole and the second communication hole to open or close a passage between the first discharge member and the second discharge member such that air introduced from the air inlet discharge through the discharge port while the wash water introduced from the water inlet prevented from passing through the first communication hole.

11. The drum washing machine according to claim 10, wherein the water inlet is coupled to a first hose through which wash water is discharged from the tub.

12. The drum washing machine according to claim 10, wherein the discharge port of the discharge member is coupled to a coupling hole of the cabinet so as to protrude outward of the cabinet, and the coupling hole is located at a point which is two-thirds from the bottom of the cabinet.

13. The drum washing machine according to claim 10, further comprising a suction member provided therein with a passage through which air between the cabinet and the tub is sucked, the suction member being coupled to a lower side of the drying duct.

14. A drum washing machine comprising:

a cabinet;

a tub arranged within the cabinet;

a drum rotatably arranged within the tub;

a drying duct to heat and circulate condensed air within the tub;

a suction member which is coupled, at one side thereof, to a lower side of the drying duct and is coupled, at other side thereof, to one side of the tub so as to communicate with the tub, a blowing fan being seated to the suction member, the suction member being configured such that air inside and outside the tub is sucked into the suction member; and a discharge member coupled to an upper side of the tub, wherein the discharge member comprises an introduction port through which air in the tub is introduced;

a discharge port through which the introduced air is discharged; and an opening and closing member to open and close a passage of air discharged to the discharge member, the opening and closing member being a buoyancy valve capable of opening and closing the passage of air using buoyancy generated by wash water.

* * * * *